US006545412B1

(12) United States Patent
Jang

(10) Patent No.: US 6,545,412 B1
(45) Date of Patent: Apr. 8, 2003

(54) PLASMA DISPLAY DEVICE

(75) Inventor: Tae-woong Jang, Chungcheongnam-do (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 241 days.

(21) Appl. No.: 09/698,024

(22) Filed: Oct. 30, 2000

(30) Foreign Application Priority Data

Nov. 2, 1999 (KR) ..... 99-48171

(51) Int. Cl.[7] ..... H01J 17/49

(52) U.S. Cl. ..... 313/587; 313/581; 313/582; 313/586; 313/313; 313/584

(58) Field of Search ..... 313/581, 582, 313/586, 587, 313

(56) References Cited

U.S. PATENT DOCUMENTS 6,008,581 A * 12/1999 Ochiai et al. ..... 313/483
6,034,474 A * 3/2000 Ueoka et al. ..... 313/489
6,078,139 A * 6/2000 Ochiai et al. ..... 313/313
6,255,778 B1 * 7/2001 Yoshikawa et al. ..... 313/473
6,429,587 B1 * 8/2002 Sugimachi et al. .... 174/35 MS

* cited by examiner

*Primary Examiner*—Nimeshkumar D. Patel
*Assistant Examiner*—Holly Harper
(74) *Attorney, Agent, or Firm*—Leydig, Voit & Mayer, Ltd.

(57) ABSTRACT

A plasma display device includes front and rear substrates, strips of a conductive material on the front substrate, and an insulating layer covering the conductive strips, first and second electrodes parallel to each other and disposed on the insulating layer and a dielectric layer covering the first and second electrodes, third electrodes perpendicular to the first and second electrodes on the rear substrate, and a dielectric layer covering an interior surface of the rear substrate and the third electrodes, barrier walls defining discharge spaces on the dielectric layer of the rear substrate, and phosphor coatings between the barrier walls. The plasma display device further includes conductive strips at positions directly opposite the barrier walls on the inner surface of the front substrate, and an insulating layer over the inner surface of the front substrate covering the conductive strips. The first and second electrodes are on the inner surface of the insulating layer, and the conductive strips are grounded.

11 Claims, 5 Drawing Sheets

PLASMA DISPLAY DEVICE

BACKGROUND OF THE INVENTION

1. Field of the Invention

The present invention relates to a plasma display device, and more particularly, to a plasma display device having a conductive strip or matrix for preventing occurrences of an electromagnetic wave.

2. Description of the Related Art

Plasma display devices utilize a gas discharge to form display images. The plasma display device has emerged as a flat panel display comparable to a cathode ray tube (CRT) in terms of picture quality since it exhibits excellent display properties such as display capacity, brightness, contrast, after-image, viewing angle, and the like. In plasma display devices, when an AC or DC voltage is applied to electrodes, a gas discharge is generated between the electrodes and the resulting radiation of ultraviolet light excites phosphors to emit light. Since the voltage required to generate a gas discharge is so high in plasma display devices, electromagnetic waves are generated, which may adversely affect humans.

FIG. 1 is an exploded perspective view showing the structure of a general AC-type plasma display device. Referring to FIG. 1, a first electrode 13X, which is a common electrode, and a second electrode 13Y, which is a scan electrode, are formed on the inner surface of a front glass substrate 11, the two electrodes forming a pair. A third electrode 13A, which is an address electrode, is formed on the inner surface of a rear glass substrate 12. The first and second electrodes 13X and 13Y, and the third electrodes 13A, respectively, are strips on the inner surface of the front and rear glass substrates 11 and 12. When the substrates 11 and 12 are put together, the first and second electrodes 13X and 13Y, and the third electrodes 13A cross each other perpendicularly. A dielectric layer 14 and a protective layer 15 are sequentially stacked on the inner surface of the front glass substrate 11. Barrier walls 17 are formed on the top surface of a dielectric layer 14' which covers the rear glass substrate 12, and cells 19 are defined by the barrier walls 17. An inert gas such as argon fills the cells 19. Further, each cell 19 is coated with phosphors 18 corresponding to red(R), green(G), or blue(B) pixels. Although not shown in FIG. 1, a bus electrode may be formed along the first and second electrodes 13X and 13Y.

The operation of a plasma display device having the above structure will now be described. First, a high voltage, which is called a trigger voltage, is applied to produce a gas discharge between the first and third electrodes 13X and 13A. Then, a discharge is created when positive ions are accumulated on the dielectric layers 14 and 14' by the trigger voltage. If the trigger voltage exceeds a threshold voltage, then argon gas within the cells 19 changes to a plasma state, and a stable discharge state can be maintained between the adjacent first and second electrodes 13X and 13Y. In the stable discharge state, ultraviolet light among discharge light bombards the phosphors 18 to produce light, which allows each pixel formed on a cell-by-cell basis to display an image.

The plasma display device described above generates electromagnetic waves when displaying an image. The harmful electromagnetic waves are emitted directly to users through the front surface of the display device. In order to prevent radiation of electromagnetic waves, usually a transparent conductive layer is formed on the surface of the front glass substrate 11 and grounded. However, the material used for transparent conductive layer is expensive and may degrade the brightness of the display device.

SUMMARY OF THE INVENTION

To solve the above problems, it is an objective of the present invention to provide a plasma display device including an improved electromagnetic-wave shielding means.

It is another objective to provide a plasma display device having a means for improving the contrast as well as blocking electromagnetic waves.

Accordingly, to achieve the objectives, the invention provides a plasma display device including: front and rear substrates; strips comprised of a conductive material, which are formed on the front substrate, and an insulating layer formed so as to cover the conductive strips; first and second electrodes disposed parallel to each other on the insulating layer and a dielectric layer formed so as to cover the first and second electrodes; third electrodes formed perpendicular to the first and second electrodes on the rear substrate, and a dielectric layer formed over the interior surface of the rear substrate so as to cover the third electrodes; barrier walls which form discharge spaces on the dielectric layer of the rear substrate; and red, green, and blue phosphors coated between the barrier walls.

The conductive strips are extended along positions right above the barrier walls. The conductive strips are extended in parallel to the first and second electrodes in non light-emitting regions disposed between the pairs of first and second electrodes. Furthermore, The conductive strips are grounded. The conductive material is copper silver, indium tin oxide (ITO), or photosensitive silver paste. The conductive strips are formed by overlapping black strips disposed toward the outside of the front substrate and white strips disposed toward the inside of the front substrate.

The present invention also provides a plasma display device including: front and rear substrates; matrices comprised of a conductive material which are formed on the front substrate, and an insulating layer formed so as to cover the matrices; first and second electrodes formed parallel to each other on the insulating layer and a dielectric layer so as to cover the first and second electrodes; third electrodes formed perpendicular to the first and second electrodes on the rear substrate, and a dielectric layer formed over the interior surface of the rear substrate so as to cover the third electrodes; barrier walls which form discharge spaces on the dielectric layer of the rear substrate; and red, green, and blue phosphors coated between the barrier walls.

BRIEF DESCRIPTION OF THE DRAWINGS

The above objectives and advantages of the present invention will become more apparent by describing in detail a prefer 3red embodiment thereof with reference to the attached drawings in which.

DETAILED DESCRIPTION OF THE INVENTION

Figure 1:
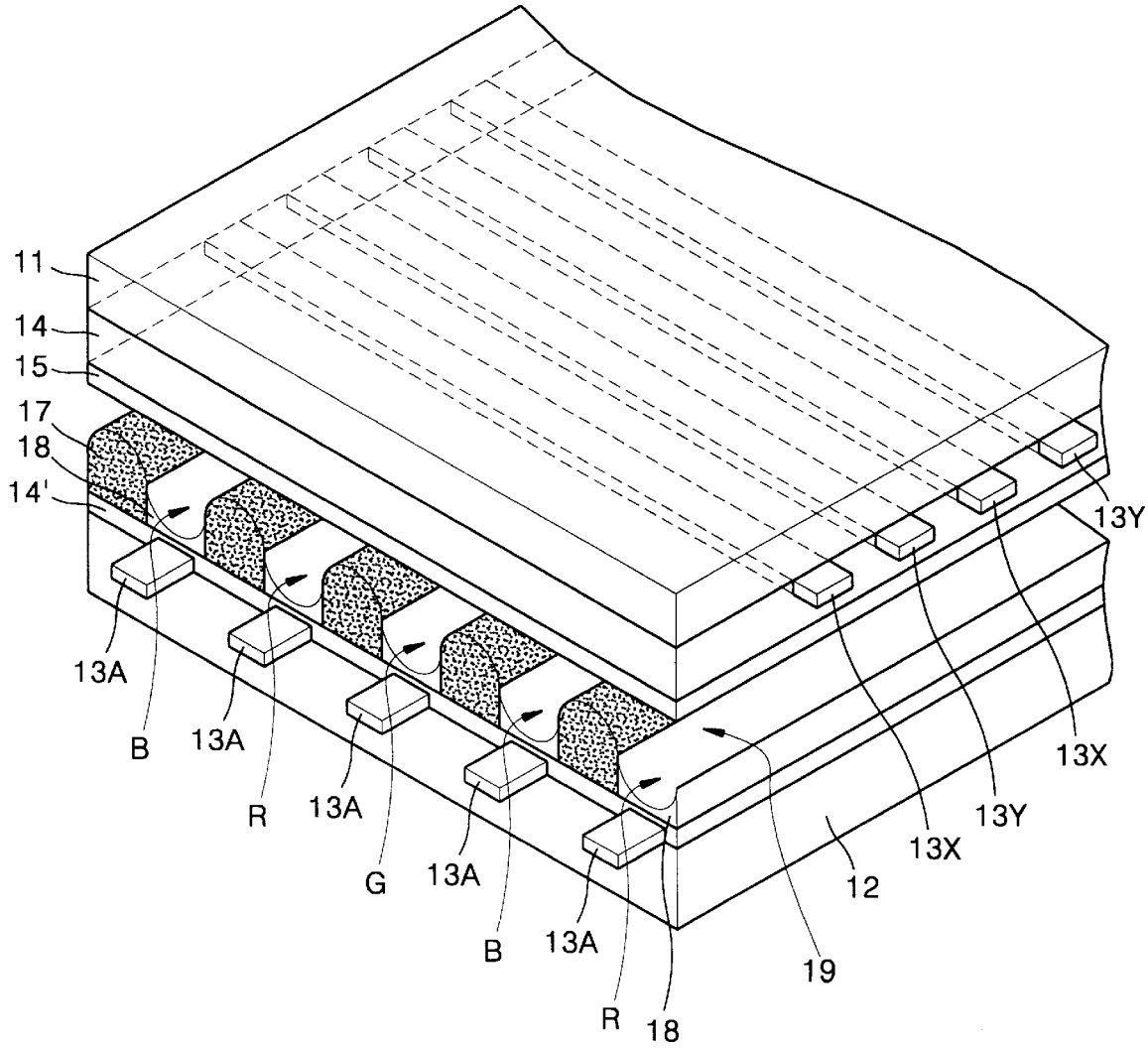
FIG. 1 is an exploded perspective view of a general plasma display device.
Figure 2:
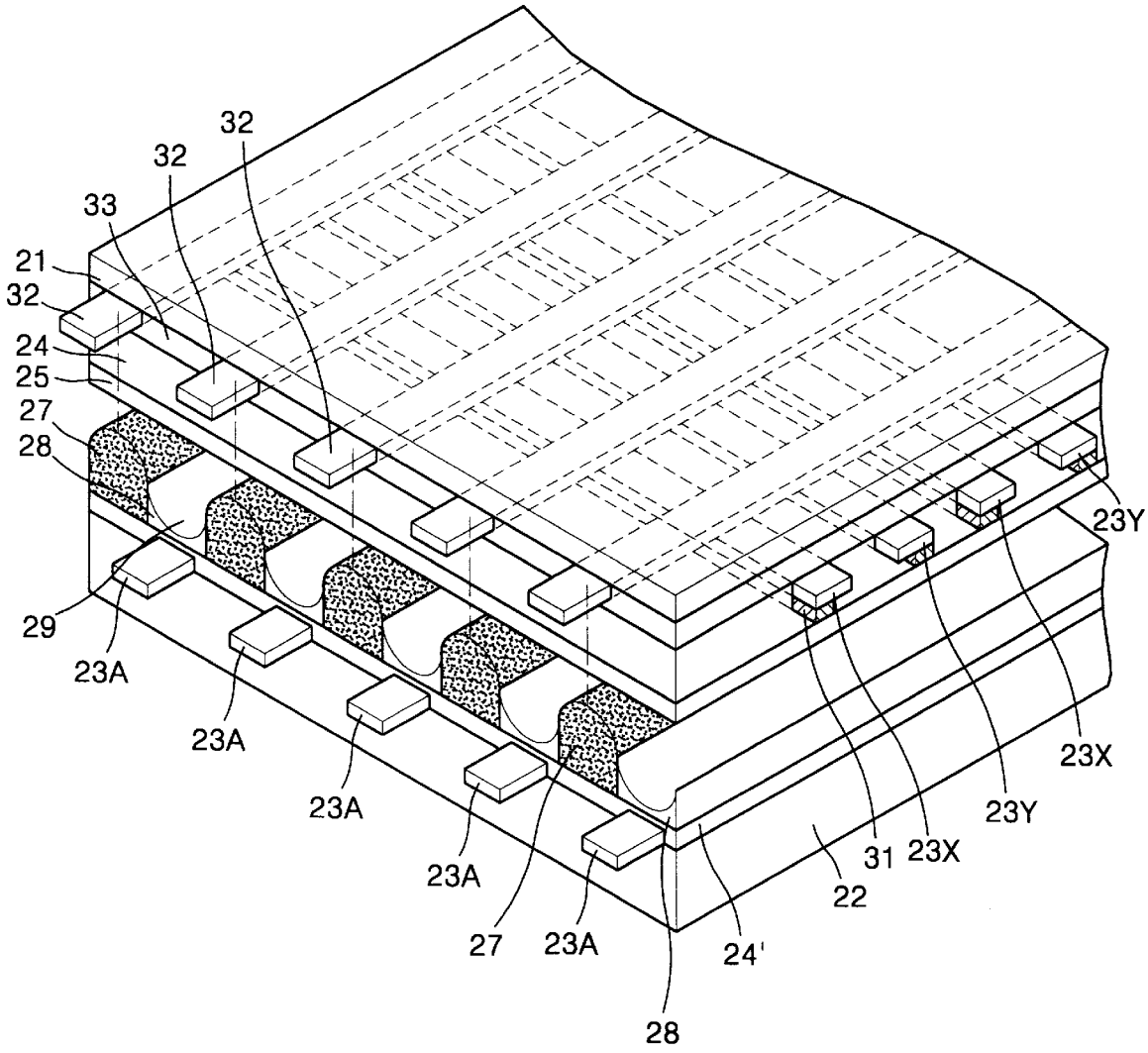
FIG. 2 is an exploded perspective view of a plasma display device according to a first embodiment of the present invention.

Referring to FIG. 2, the basic structure of a plasma display device according to the present invention is similar to that of the plasma display device shown in FIG. 1. First, strips 32 made of a conductive material are formed on the inner surface of a front glass substrate 21, and an insulating layer 33 is formed to cover the conductive strips 32. The insulating layer 33 may be a material such as silicon dioxide. Transparent first and second electrodes 23X and 23Y are arranged in pairs on top of the insulating layer 33. Third electrodes 23A are formed on the inner surface of the rear glass substrate 22. When the glass substrates 21 and 22 are assembled, the first and second electrodes 23X and 23Y cross the third electrodes 23A at right angles. A dielectric layer 24 and a protective layer 25 are sequentially formed on the insulating layer 33 to cover the first and second electrodes 23X and 23Y.

Meanwhile, barrier walls 27 are formed on the top surface of a dielectric layer 24' covering the rear glass substrate 22, and cells 29 are defined by the barrier walls 27. An inert gas such as argon fills the cells 29. Further, a predetermined portion of the inner side of the barrier rib 27 forming each cell 29 is coated with a phosphor 28 producing to red(R), green(G), or blue(B) light. Reference numeral 31 denotes a bus electrode extending along the first and second electrodes 23X and 23Y.

As described above, the distinguishing feature of the invention is that the conductive strips 32 and the insulating layer 33 are located between the front glass substrate 21 and the dielectric layer 24. Preferably, the conductive strips 32 may be any material having excellent conductivity, for example, copper (Cu), silver (Ag), indium tin oxide (ITO), or photosensitive Ag paste. Fodel available from Dupont Co., may be used as the photosensitive Ag paste. The conductive strips 32 may be black. The conductive strips 32 are provided in strips on the inner surface of the front glass substrate 21, the strips 32, being directly opposite the barrier walls 27. The insulating layer 33 on the inner surface of the front glass substrate 21 covers the conductive strips 32, and the dielectric layer 24 is on top of the insulating layer 33.

The conductive strips 32 must be grounded. Electromagnetic waves are absorbed by the conductive strips 32, thereby preventing emission of the, electromagnetic waves through the front of the plasma display device. An area directly opposite the barrier walls 27 is a non light-emitting region through which light emitted from the cell 29 does not pass. If the conductive strips 32 are disposed directly opposite the barrier walls as shown in FIG. 2, the conductive strips 32 do not affect the brightness of the display even if they are not made from a transparent material. Furthermore, crosstalk, in which light emitted from one cell interferes with light emitted from an adjacent cell, may be avoided by the conductive strips 32. The insulating layer 33 to secures electrical insulation between the bus electrode 31, the first electrode 23X and the second electrode 23Y, respectively, and the conductive strips 32. Furthermore, the insulating layer 33 makes it easy to extract a ground line to the outside. As the insulating layer 33, a transparent insulator such as silicon oxide or titanium oxide may be used.

Figure 3:
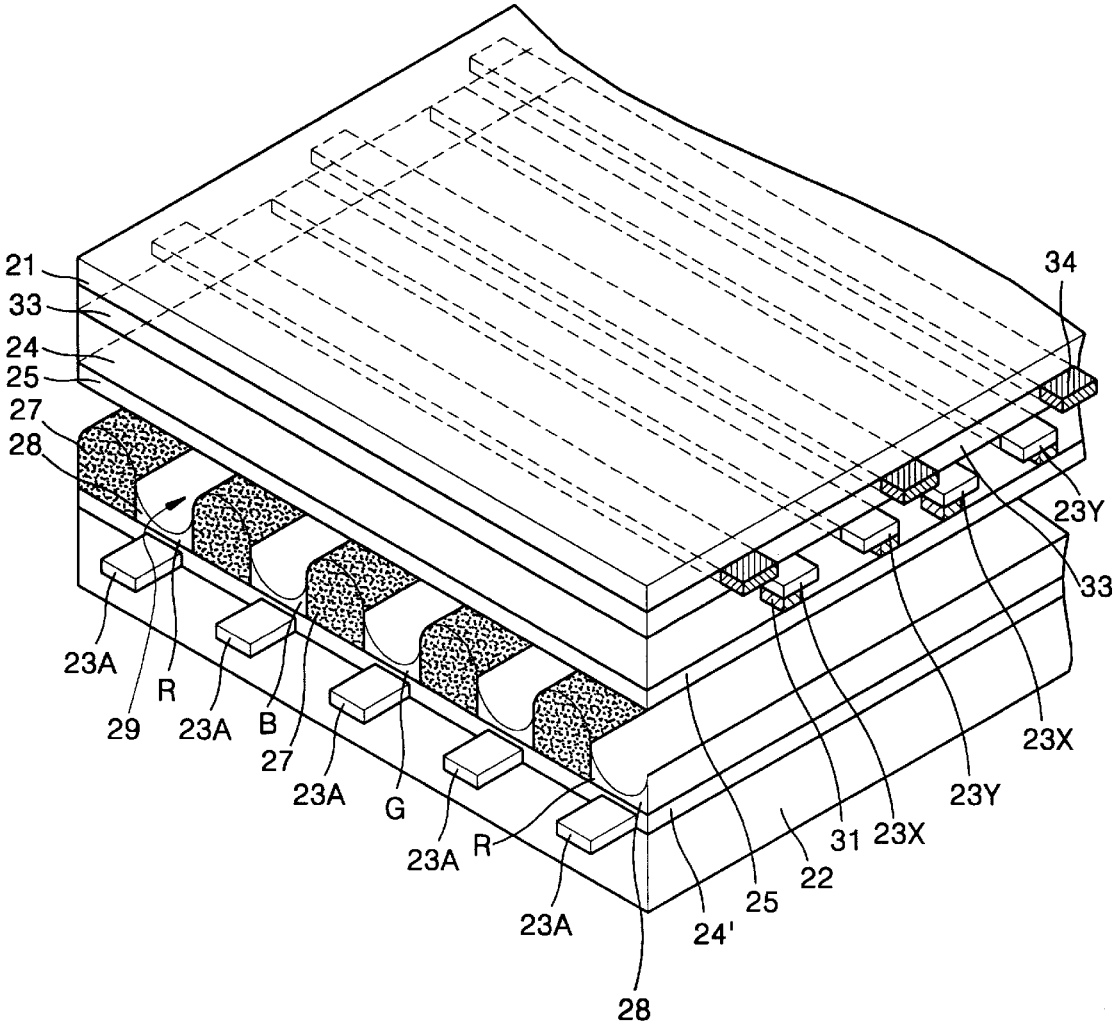
FIG. 3 is a perspective view of a plasma display device according to a second embodiment of the invention.

FIG. 3 is a perspective view of a plasma display device according to a second embodiment of the invention. Referring to FIG. 3, one can see that the general construction of the second embodiment is similar to the embodiment shown in FIG. 2, and the same reference numerals denote the same elements. Barrier walls 27 are located between front and rear glass substrates 21 and 22. First and second electrodes 23X and 23Y are perpendicular to third electrodes 23A.

The distinguishing feature of the second embodiment of the invention is that strips 34 comprised of a conductive material and an insulating layer are provided between the front glass substrate 21 and a dielectric layer 24. The conductive strips 34 are parallel to the first and second electrodes 23X and 23Y, unlike the embodiment shown in FIG. 2, and disposed in a non light-emitting region between the pair of first and second electrodes 23X and 23Y. The material for the conductive strips 34 may be as described above, and may be black. The insulating layer 33 is provided over the inner surface of the front glass substrate 33 covering the conductive strips 34. The dielectric layer 24 is on top of the insulating layer 33. The conductive strips 34 must be grounded, and electromagnetic waves are absorbed through the conductive strips 34 as in the first embodiment. The conductive strips 34 are disposed in a non light-emitting region between the pair of the first and second electrodes 23X and 23Y, as shown in FIG. 3, and thus does not degrade the brightness of the device even if the conductive strips are not made of a transparent material.

Figure 4:
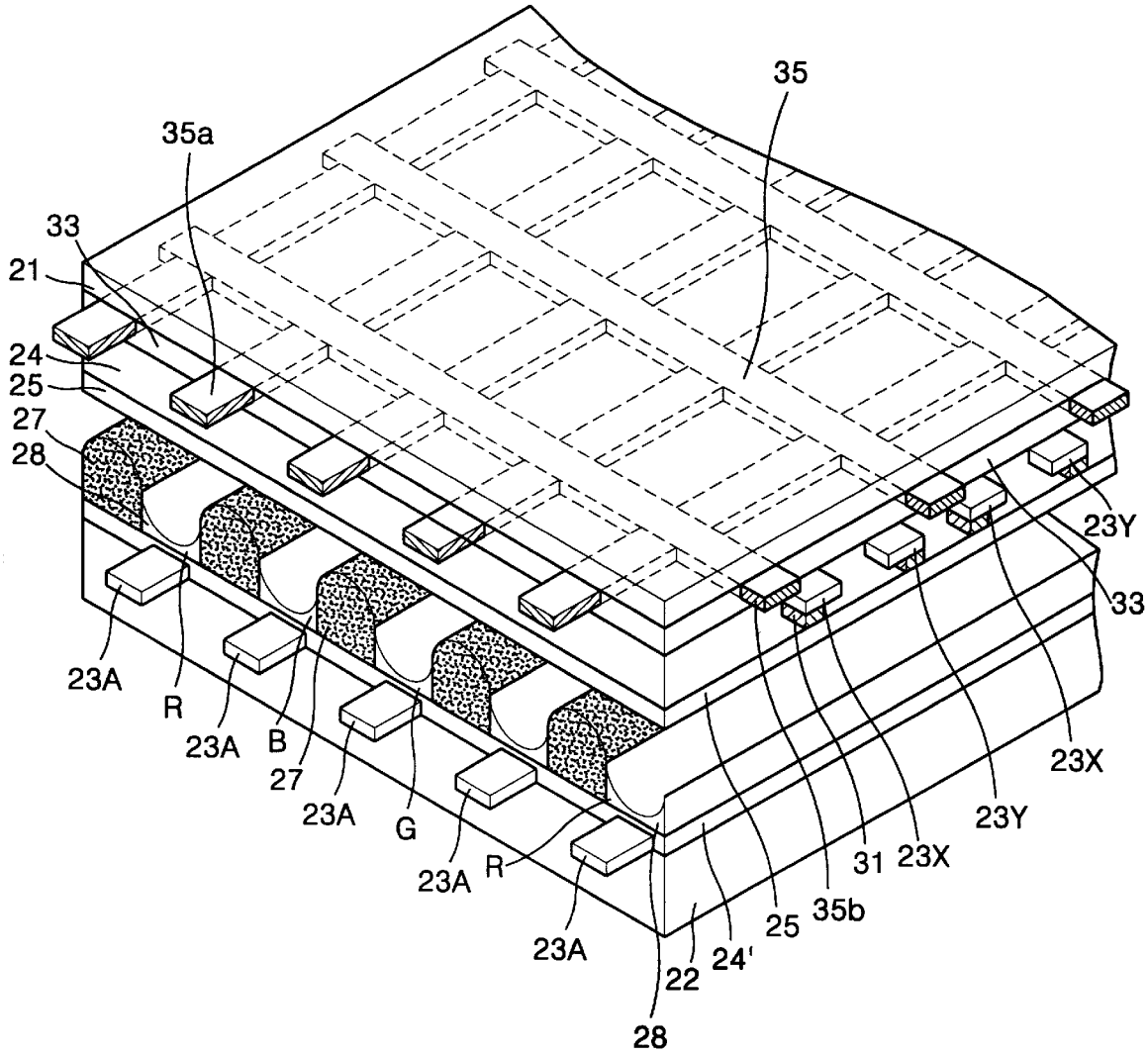
FIG. 4 is a perspective view of a plasma display device according to a third embodiment of the invention.

FIG. 4 is a perspective view of a plasma display device according to a third embodiment of the invention. Referring to FIG. 4, the overall construction thereof is similar to the embodiments shown in FIGS. 2 and 3, and the same elements are denoted by the same reference numerals. Specifically, barrier walls 27 are located between the front and rear glass substrates 21 and 22. First and second electrodes 23X and 23Y are perpendicular to third electrodes 23A.

The distinguishing feature of the third embodiment of the invention is a matrix 35 made of a conductive material and insulating layer 33 located between the front glass substrate 21 and a dielectric layer 24. The conductive matrix 35 is formed by intersecting strips 35*a* disposed directly opposite the barrier walls 27 and strips 35*b*, parallel to the first and second electrodes 23X and 23Y in a non light-emitting region between the first and second electrodes 23X and 23Y. In the matrix 35, the conductive strips 32 of FIG. 2 and 34 of FIG. 3 are formed together, i.e., are in the same layer, and are perpendicular to each other. The material for the conductive matrix 35 may be as described above. The insulating layer 33 is provided over the inner surface of the front glass substrate 21 covering the conductive matrix 35, and the dielectric layer 24 is on top of the insulating layer 33. The conductive matrix 35 must be grounded, and electromagnetic waves are absorbed by the conductive matrix 35 as described above.

Figure 5:
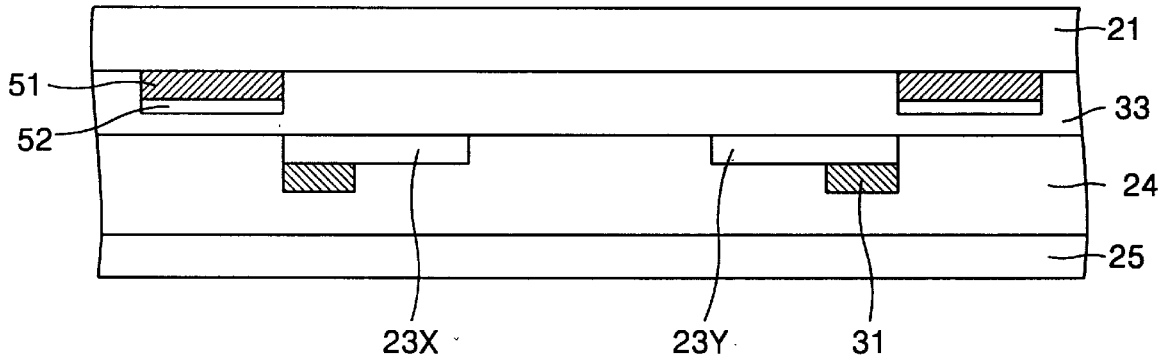
FIG. 5 is a cross-sectional view of a portion of a plasma display device according to a fourth embodiment of the invention.

FIG. 5 shows an fourth embodiment of the invention and a cross sectional view of a front glass substrate. Referring to FIG. 5, conductive strips 51 are on the inner surface of the front glass substrate 21, and an insulating layer 33 covers the strips 51. First and second electrodes 23X and 23Y are formed on the inner side of the insulating layer 33, and a dielectric layer 24 covers the electrodes 23X and 23Y. A bus electrode 31 is on the first and second electrodes 23X and 24Y. The conductive strip 51 is parallel to the first and second electrodes 23X and 23Y in a non light-emitting region between the first and second electrodes 23X and 23Y.

The distinguishing feature of the fourth embodiment of the invention is that the strips 51 are black, and white strips 52 made of a conductive material are stacked on the black strips 51. The white strips 52 overlay the black strips 51 with the same length and width and are grounded together with the black strips 51. The black and white conductive strips 51 and 52 may be applied to the embodiments shown in FIGS. 2–4. Emitted electromagnetic waves are absorbed by the strips 51 and 52. Here, if the black strips 51 conduct reliably, there is no need to form the white strips 52. However, if the black strips 51 are photosensitive Ag paste material (i.e., Fodel), their resistance is large and they are not sufficiently conductive. Thus, in this case, the white strips 52 are formed on top of the black strips 51 thereby providing sufficient conductivity. Since a metal such as aluminum has high reflectivity, if only-white strips 52 are provided, external light is reflected and degrades the contrast. In order to prevent this, the black strips 51 are located on outward direction of the panel, and the white strips 52 are located at an inward direction of the panel.

If the white strips 52 are copper or aluminum, the white strips 52 themselves are white, and the black strips 51 may be chrome. Furthermore, if Fodel, which is white, is to be used as the black strips 51, a black pigment can be mixed with Fodel to obtain a black Fodel. In this case, conductivity is significantly weakened in the black Fodel, as described above.

A plasma display device according to the invention can absorb emitted electromagnetic waves by means of conductive strips at a matrix thereby reducing and removing harmful electromagnetic waves. Forming conductive strips directly opposite barrier walls can prevent crosstalk, thus improving contrast. Furthermore, even in the case in which conductive strips are disposed to first and second electrodes, the conductive strips are located in a non light-emitting region, which does not affect brightness. Black strips may reduce reflection of external light, which improves contrast as well. In addition, a plasma display device according to the invention can be easily manufactured using inexpensive material.

Although this invention has been particularly shown and described with references to preferred embodiments thereof, the illustrated embodiments are only examples, and it will be understood by those skilled in the art that various changes in form and details may be made therein without departing from the spirit and scope of the invention as defined by the appended claims.

What is claimed is:

1. A plasma display device comprising:

front and rear substrates;

conductive strips disposed on the front substrate and including black strips disposed towards an outside of the front substrate and white strips, overlapping the black strips, disposed toward an inside of the front substrate;

an insulating layer covering the conductive strips;

first and second electrodes parallel to each other and disposed on the insulating layer and a dielectric layer covering the first and second electrodes;

third electrodes perpendicular to the first and second electrodes on the rear substrate, and a dielectric layer over an interior surface of the rear substrate covering the third electrodes;

barrier walls defining discharge spaces on the dielectric layer of the rear substrate; and red, green, and blue phosphor coatings between the barrier walls.

2. The plasma display device of claim 1, wherein the conductive strips extend along positions directly opposite the barrier walls.

3. The plasma display device of claim 1, wherein the conductive strips extend in parallel to the first and second electrodes in non light-emitting regions disposed between the pairs of first and second electrodes.

4. The plasma display device of claim 1, wherein the conductive strips are grounded.

5. The plasma display device of claim 1, wherein the conductive strips are a material selected from the group consisting of copper, silver, indium tin oxide, and photosensitive silver paste.

6. The plasma display device of claim 1, wherein the black stripes comprise a mixture of silver paste and a black pigment and the white strips are selected from the group consisting of copper and aluminum.

7. A plasma display device comprising:

front and rear substrates;

a conductive matrix disposed on the front substrate and including black strips disposed toward an outside of front substrate and white strips, overlapping the black strips, disposed toward an inside of the front substrate;

an insulating layer covering the matrix;

first and second electrodes parallel to each other on the insulating layer and a dielectric layer covering the first and second electrodes;

third electrodes perpendicular to the first and second electrodes on the rear substrate, and a dielectric layer over an interior surface of the rear substrate covering the third electrodes;

barrier walls defined discharge spaces on the dielectric layer of the rear substrate; and red, green, and blue phosphor coatings between the barrier walls.

8. The plasma display device of claim 7, wherein the conductive matrix comprises strips extending along positions directly opposite the barrier walls, and strips extending parallel to the first and second electrodes in non light-emitting regions disposed between the pairs of first and second electrodes.

9. The plasma display device of claim 7, wherein the conductive matrix is grounded.

10. The plasma display device of claim 7, wherein the conductive matrix includes a material selected from the group consisting of copper, silver, indium tin oxide, and photosensitive silver paste.

11. The plasma display device of claim 7 wherein the black stripes comprise a mixture of silver paste and a black pigment and the white strips are selected from the group consisting of copper and aluminum.

* * * * *